US010279387B2

(12) United States Patent
Dubugnon et al.

(10) Patent No.: US 10,279,387 B2
(45) Date of Patent: May 7, 2019

(54) TOOL FOR MAKING JOINTS OF CLINCH TYPE

(71) Applicant: BOLLHOFF ATTEXOR SA, Ecublens (CH)

(72) Inventors: Olivier Dubugnon, Vullierens (CH); Jean-Claude Faivre, Renens (CH)

(73) Assignee: BOLLHOFF ATTEXOR SA, Ecublens (CH)

( * ) Notice: Subject to any disclaimer, the term of this patent is extended or adjusted under 35 U.S.C. 154(b) by 10 days.

(21) Appl. No.: 15/033,673

(22) PCT Filed: Nov. 4, 2014

(86) PCT No.: PCT/EP2014/073718
§ 371 (c)(1),
(2) Date: May 2, 2016

(87) PCT Pub. No.: WO2015/063333
PCT Pub. Date: May 7, 2015

(65) Prior Publication Data

US 2016/0236260 A1 Aug. 18, 2016

(30) Foreign Application Priority Data

Nov. 4, 2013 (SE) ..... 1300686-1

(51) Int. Cl.
*B21D 39/03* (2006.01)

(52) U.S. Cl.
CPC ..... *B21D 39/031* (2013.01)

(58) Field of Classification Search
None
See application file for complete search history.

(56) References Cited

U.S. PATENT DOCUMENTS 4,930,203 A * 6/1990 Obrecht ..... B21D 39/031 29/2.1
5,315,743 A 5/1994 Scheicher
(Continued)

FOREIGN PATENT DOCUMENTS

DE 43 33 052 3/1995
DE 4435460 4/1996
(Continued)

OTHER PUBLICATIONS

English Machine Translation of CN 100080 62681616 Office Action, Feb. 2019, attached as pdf (Year: 2019).*
(Continued)

*Primary Examiner* — Joseph J Hail
*Assistant Examiner* — Brian D Keller
(74) *Attorney, Agent, or Firm* — Jeffrey S. Melcher; Melcher Patent Law PLLC

(57) ABSTRACT

A tool making joints of clinch type between two or several sheet formed members, which tool comprises two separate tool parts, a first tool-part with a punch and a second tool-part provided with a die which co-operate for producing said joint. The punch is arranged to be driven in a linear movement in the direction of the co-axial die provided with a die cavity at the bottom of which an anvil (3) is arranged. A spring element (5) having the general form of a cylindrical cage has a surface which has been provided with a number of slots to form a corresponding number of long elastic arms (11) partitioned around the circumference of the cage with their free ends at the upper edge of the cage. Said free end of each arm (11) is provided with a bent flange (12) arranged to bear laterally against a corresponding movable element (4) to transfer the spring force to said element, and said bent flange (12) is additionally arranged to grip around a heel portion (13) of the corresponding movable element (4) in
(Continued)

order to block the die element for axial movement relative to the cage being fixed to the die body.

9 Claims, 1 Drawing Sheet

(56) References Cited

U.S. PATENT DOCUMENTS

| | | | | |
|---|---|---|---|---|
| 5,509,290 | A * | 4/1996 | Faivre | B21D 39/031 29/21.1 |
| 5,946,782 | A | 9/1999 | Dubugnon | |
| 5,992,206 | A | 11/1999 | Kuehne Timm | |
| 9,050,645 | B2 | 6/2015 | Dubugnon | |
| 2004/0108121 | A1* | 6/2004 | Lowther | B21D 1/06 173/90 |
| 2011/0258824 | A1* | 10/2011 | Dubugnon | B21D 39/031 29/283.5 |
| 2014/0099156 | A1* | 4/2014 | Weber | B60J 7/1204 403/119 |

FOREIGN PATENT DOCUMENTS

| | | |
|---|---|---|
| EP | 0744231 | 11/1996 |
| EP | 1389499 | 2/2004 |
| EP | 2138249 | 12/2009 |
| EP | 2517804 | 10/2012 |
| JP | 2005131699 | 5/2005 |
| WO | 0136124 | 5/2001 |

OTHER PUBLICATIONS

International Search Report Issued in PCT/EP2014/073718, dated Feb. 17, 2015, pp. 1-3.

Written Opinion Issued in PCT/EP2014/073718, dated Feb. 17, 2015, pp. 1-5.

Chinese Office Action issued in corresponding chinese patent application No. 100080, 62681616, Feb. 11, 2019, pp. 1-11.

* cited by examiner

TOOL FOR MAKING JOINTS OF CLINCH TYPE

TECHNICAL FIELD

The present invention relates to a tool for making joints of the so called clinch type between two or several sheet formed members of metal or non-metal. More particularly the invention refers to a tool for making small or very small joints with diameters of the order of a few millimeters.

BACKGROUND ART

The technique as such is well known in the art. A suitable tool comprises generally two separate tool parts which co-operate for producing said joint. A first tool part has the form of a punch which in a linear movement is driven in the direction of a co-axial second tool part in the form of a die with a die cavity at the bottom of which an anvil is arranged.

For making the joint the sheet formed members are positioned against the second tool part, the die, provided with movable die elements arranged sliding laterally on a support surface against the forces from a resilient element. The resilient element could be a ring made of an elastomer or a toroid formed metal spring surrounding the movable die elements.

The approaching punch impacts on the surface of one of the members to be joined. The material of the two members is first drawn into the die cavity and subsequently due to the interaction between the punch and the anvil at the bottom of the cavity laterally extruded thereby displacing the movable die elements outwardly creating in the sheet formed members a mushroom formed button which interlocks the members.

A tool of this type is e.g. shown in the document U.S. Pat. No. 5,946,782, published as WO97/02912 on 30 Jan. 1997, incorporated here by reference. FIG. 1 and FIG. 2 of that document show a tool for making joints between sheet-formed members 4, 5 comprising a first tool-part 1, 2, 3 with a punch 1 and a side pressing element 2 and a second tool-part 6, 11 provided with a support surface 9 from which an anvil 8 erects, a matrix 6' comprising at least two matrix-parts 6 each having an upper active matrix surface 13 and being arranged around said anvil 8. Each matrix part comprises a portion 14 arranged sliding against said support surface 9 and being applied against the lateral surface of said anvil 8 by means of elastic means 7. Retention means 10 are arranged limiting the longitudinal movement of the matrix parts during the retraction of the punch 1. The upper active matrix surface 13, the portion 14 arranged sliding against said support surface 9 and said retention means 10 are arranged in that order from the top of the second tool-part 6, 11

The present invention is more particularly directed to such a second tool part in the form of a die with a die cavity at the bottom of which an anvil is arranged which second tool part is provided with a special type of resilient element.

The document EP12178068 shows a resilient or spring element which has the general form of a cage the surface of which has been provided with a number of slots having an acute angle, not necessary constant, relative the axis of the cage to form a corresponding number of long elastic arms or blades equally partitioned around the circumference. This resilient member produces the force against which the movable die elements are laterally displaced during the joining process. When the punch is retracted the movable die elements in contact with the deformed sheet members will be subjected to a vertical force trying to lift them up from their support surface. To prevent this, cooperating arrangements on the die elements and support elements on the die, parallel to the direction of the sliding movement of the die elements, have been provided. Thus, the resilient or spring element according to this document does not contribute to the retention of the movable die elements when the punch is retracted. As a consequence the cage formed spring element does not have to be fixed to the die body in the direction of the die axis.

BRIEF DESCRIPTION OF THE INVENTION

The present invention has applications especially for producing joints of smaller dimensions but certain embodiments could also be used for larger dimensions. Joints of these dimensions find applications in e.g. watch industry, electronics and electrical industry as well as in automotive industry.

One of the objects of the present invention is to provide a second tool part which has laterally very small dimensions.

Another object of the invention is to provide a second tool part on which the spring element has the double function of providing the lateral resilient force during the formation of the joint as well as the vertical retaining function when the punch in the first tool part is retracted.

Another object of the invention is to provide a second tool part on which the spring element is easily mounted and if necessary replaced.

The present invention, which provides a solution to the said technical problems, is characterised according to the appended claims.

BRIEF DESCRIPTION OF THE FIGURES

Other objects and advantages of this invention will be apparent from the reading of this description which proceeds with reference to the accompanying drawings forming part thereof and wherein.

DETAILED DESCRIPTION OF THE INVENTION

Figure 1A:
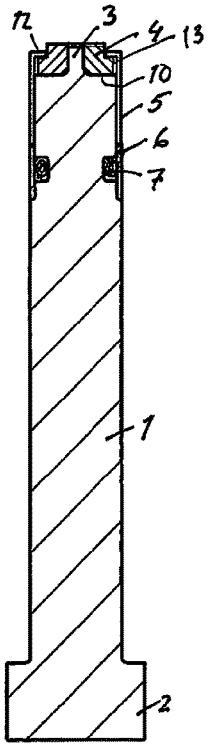
FIGS. 1A-D show in different views embodiments of the second tool part according to the invention.

FIGS. 1A-D show in different views embodiments of the second tool part according to the invention. FIG. 1A shows a first embodiment of the tool part in section. The tool part body 1 is in its upper part opposite the foot 2 provided with a support surface 10 for two movable die elements 4. The number of die elements is at least two in all the embodiments. At the centre of the support surface 10 is in the embodiment according to FIG. 1A arranged an anvil 3 which is protruding vertically upwards from that surface. In another embodiment the anvil be could be formed by the central portion of the horizontal support surface 10 itself. In the joint forming process the sheet formed members are laterally extruded on top of the anvil 3 thereby displacing the movable die elements 4 outwardly against the force from the spring element 5.

Figure 1B:
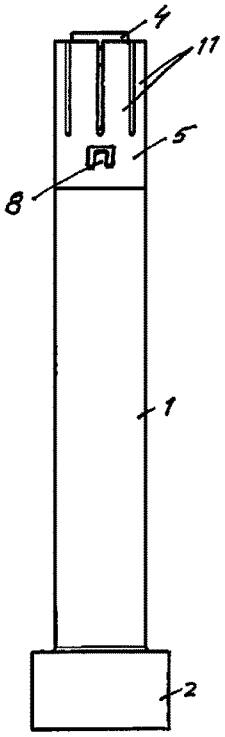
Figure 1C:
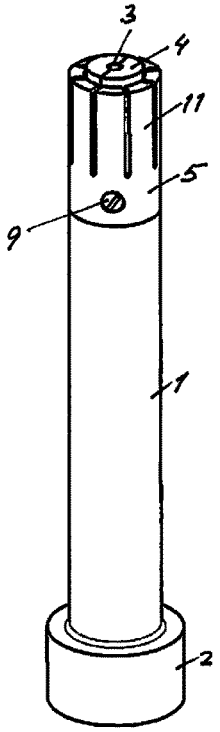
Figure 1D:
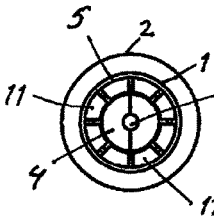

The general form of the spring element can be more clearly seen in the FIGS. 1B-D. It has the form of a cylindrical cage or sleeve the surface of which has been provided with a number of slots. It is made of some suitable resilient material and the material the form and length of the slots are chosen to give the appropriate resilient force for the movable elements 4. In the shown embodiments the slots are arranged vertically and parallel to the tool axis forming a number of long resilient arms or blades 11 partitioned around the circumference of the cage with their free ends at the upper edge of the cage 5. However, the slots could be arranged with an angle to the axis of the cage in order to increase the length of the arms 11. The slots could also be arranged to give the arms a tapered form in the direction of the free ends in order to change the resilient properties.

The free end of each blade 11 is provided with a bent flange 12 arranged to bear laterally against the movable element 4 to transfer the resilient force to said element and at the same time to grip around a heel portion 13 of the movable die element 4. Thus, if the cage 5 is then fixed to the die body 1 so that it is blocked for axial movement relative to this body for vertical forces transferred through the movable die elements emanating from the retraction of the deformed sheet members at the end of the joining procedure, then the die elements 4 will stay in contact with the support surface 10.

The fixing of the cage 5 to the die body 1 can be made in different ways. For small dimensions of the joints a particularly simple arrangement of the fixing is shown in FIG. 1A. The die body 1 has been provided with a circular groove 6 around its circumference receiving an ordinary O-ring 7. The cage 5 is mounted by sliding the same over the die from the top portion of the same. The inner diameter of the cage 5 corresponds to the outer diameter of the die body 1 in this location. The dimensions of the groove 6 and the O-ring 7 are chosen so that the O-ring will be compressed between the cage and the bottom- and side walls of the groove 6 creating enough friction between the cage 5 and the die body 1 to keep the cage in place.

Another arrangement for the fixing is shown in FIG. 1B. Here the cage 5 has been provided with one or several tongues 8 e.g. stamped out in the side wall of the cage 5. These tongues could be fitting into the same groove as described above or in separate holes arranged in the die body 1. If the tongues are pre-formed e.g. bent inwards a suitable snap-in function could be created.

In FIG. 1C a straightforward solution with a fixing screw 9 is shown. Instead of a screw a pin in a through hole could of course be envisaged.

As at least one arm 11 is needed for each movable die element 4 the number of arms will be at least two. In the embodiments shown in the FIGS. 1A-D the number of arms 11 is four per movable die element 4, thus all together eight arms for two die elements. Two or three arms per die element could of course also be envisaged.

A tool part as described above can thus be installed to co-operate with a suitable punch in e.g. a C-frame work head. Multiple tool arrays with these tool pairs are also possible. Typical die diameters could be 1.0 to 2.0 mm, and the tooling can be used for joining sheet metal thicknesses from e.g. 2×0.1 mm to 2×0.5 mm. Other dimensions of tooling according to the inventive idea are of course also possible.

The invention claimed is:

1. A tool part comprising:

an elongated cylindrical die body having a die body outer diameter;

a foot at a first end of the die body, the foot having a foot outer diameter greater than the die body diameter;

a support surface arranged at a second end of the die body perpendicular to a length axis of the die body, the second end being opposite the first end;

an anvil protruding upwards from the support surface, the anvil having an anvil outer diameter less than the die body outer diameter;

at least two movable die elements arranged sliding laterally on the support surface and surrounding the anvil, the movable die elements forming a die cavity with the anvil located at a bottom of the die cavity;

a spring element arranged to bias the movable die elements against a side surface of the anvil and against the support surface, the spring element having a spring outer diameter, the spring outer diameter is the same as the die body outer diameter, wherein the at least two movable die elements each having an outwardly protruding heel portion, the spring element has the general form of a cylindrical cage, the cylindrical cage having a number of slots to form a corresponding number of long elastic arms partitioned around a circumference of the cylindrical cage with free ends of the long elastic arms at an upper edge of the cylindrical cage, the free end of at least one arm is provided with a bent flange, an end surface of the bent flange is arranged to bear laterally against a corresponding one of the movable die elements to transfer the spring force to the one of the corresponding movable die elements and bias the one of the corresponding movable die elements against the side surface of the anvil, a bottom surface of the bent flange is arranged to contact a top surface of the heel portion of the one of the corresponding movable die elements to bias the one of the corresponding movable die elements against the support surface and block the one of the corresponding movable die elements for axial movement relative to the cylindrical cage; and a spring retainer configured to retain the spring to the die body, the spring retainer is solely within the spring outer diameter, wherein the tool part is configured for making joints of clinch type between two or several sheet formed members by driving a punch against the anvil with the sheet formed members between the punch and the anvil.

2. The tool part according to claim 1, wherein a number of slots partitioned around a circumference is greater than or equal to a number of the movable die elements.

3. The tool part according to claim 1, wherein the cylindrical cage is fixed to the die body by means of an intermediate O-ring located in a circular groove on the die body being compressed between the cage and the die body.

4. The tool part according to claim 1, wherein the cylindrical cage is fixed to the die body by means of one or several tongues located in a side wall of the cage fitting into a groove or separate holes in the die body.

5. The tool part according to claim 1, wherein the cylindrical cage is fixed to the die body by means of one or several screws or pins.

6. The tool part according to claim 1, wherein the slots are rectilinear.

7. The tool part according to claim 1, wherein the slots are parallel to a longitudinal axis of the die body.

8. The tool part according to claim 1, wherein the slots are equally partitioned along a circumference of the die body.

9. The tool part according to claim 1, wherein the slots are arranged having a same angle relative to a longitudinal axis of the die body.

* * * * *